United States Patent [19]

Charneski et al.

[11] Patent Number: 4,934,949

[45] Date of Patent: Jun. 19, 1990

[54] SELF-CLEANING HOT LINE CLAMP

[75] Inventors: Mitchell D. Charneski, Southfield; Ralph G. Bonser, Livonia, both of Mich.

[73] Assignee: The Detroit Edison Company, Detroit, Mich.

[21] Appl. No.: 412,086

[22] Filed: Sep. 25, 1989

[51] Int. Cl.[5] ..... H01R 4/24

[52] U.S. Cl. ..... 439/387; 439/479; 439/803

[58] Field of Search ..... 439/387, 477, 478, 479, 439/480, 481, 803

[56] References Cited

U.S. PATENT DOCUMENTS 2,107,061 2/1938 Pittman et al. ..... 439/803

3,544,956 12/1970 Bricker, Jr. ..... 439/803

*Primary Examiner*—Joseph H. McGlynn

*Attorney, Agent, or Firm*—Barnes, Kisselle, Raisch, Choate, Whittemore & Hulbert

[57] ABSTRACT

A self-cleaning hot line clamping device used by electric utilities, having clamps for electrically connecting a line conductor to another piece of electrical equipment such as a second line conductor or tap conductor. At least one of the clamps has a first jaw in the form of a V-shaped recess, and a second jaw to force a line conductor into the recess in wedging contact with the converging surfaces of the recess. The converging surfaces of the recess are serrated to have a wiping action on the line conductor at the contact points so that when the line conductor is forced into the recess surface oxide on the line conductor at the contact points will be removed.

10 Claims, 1 Drawing Sheet

SELF-CLEANING HOT LINE CLAMP

This invention relates generally to clamping devices and refers more particularly to a hot line clamp.

BACKGROUND OF THE INVENTION

Aluminum and copper hot line clamps are used by electric utilities for mechanically and electrically joining one overhead line conductor to another or to a power transformer, lightning arrester, capacitor bank or other piece of electrical equipment.

One of the problems associated with the use of present day hot line clamps is that the conductor must be wire brushed prior to application of the clamp, to remove surface oxide. Surface oxide increases electrical resistance at the contact points. Should a hot line clamp be used on an old or insufficiently cleaned conductor, the clamp will overheat at the contact points under the current loading and may melt and drop the line. Overheating is caused by poor electrical contact due to the presence of surface oxide on the conductor. The thicker the oxide film the more the overheating and hence the more critical the problem.

Adding to the problem is the fact that the clamp is usually clamped on to at least one of the conductors by an eyebolt which is turned and tightened by a lineman with a long pole called a hotstick or shotgun. Torque applied to the eyebolt by a hotstick or shotgun is on the order of 16 to 20 pounds which in many cases is not enough to make a good contact. This increases the likelihood of failure even when only a relatively thin oxide film is present on the conductor.

SUMMARY OF THE INVENTION

The hot line clamp of this invention is self-cleaning and accordingly eliminates a significant factor contributing its failure. When the line conductor is clamped, a wiping action takes place on the surface of the conductor to remove oxide at the contact points. More particularly, the clamp has a jaw which is in the form of a V-shaped recess with converging surfaces extending at an acute angle to one another. The line conductor is forced into the recess in wedging contact with the converging surfaces. These converging surfaces have a wiping action on the line conductor at the contact points so that surface oxide at the contact points is removed. This obviates the need for wire brushing the conductor before it is clamped.

Further in accordance with the invention, the converging surfaces are preferably serrated to enhance their ability to wipe away surface oxide.

Another feature of the invention and to increase the torque applied to the line conductor by providing a thrust bearing between one of the clamp jaws and the eyebolt and by anodizing the eyebolt.

Objects of this invention include the provision of a hot line clamp having the features described above which is capable of having a self-cleaning action on a line conductor to make a good electrical contact, and which constitutes an improvement over prior art devices including those described in the following U.S. Pat. Nos.:

1,777,395: Coon
1,968,736: Bodendieck
2,089,718: Teitelbaum
2,785,217: Harley
2,864,071: Johnson 3,624,592: Walter
4,133,591: West
4,643,512: Prodel These and other objects of the invention will become more apparent as the following description proceeds, especially when considered with the accompanying drawings.

DETAILED DESCRIPTION

Figure 2:
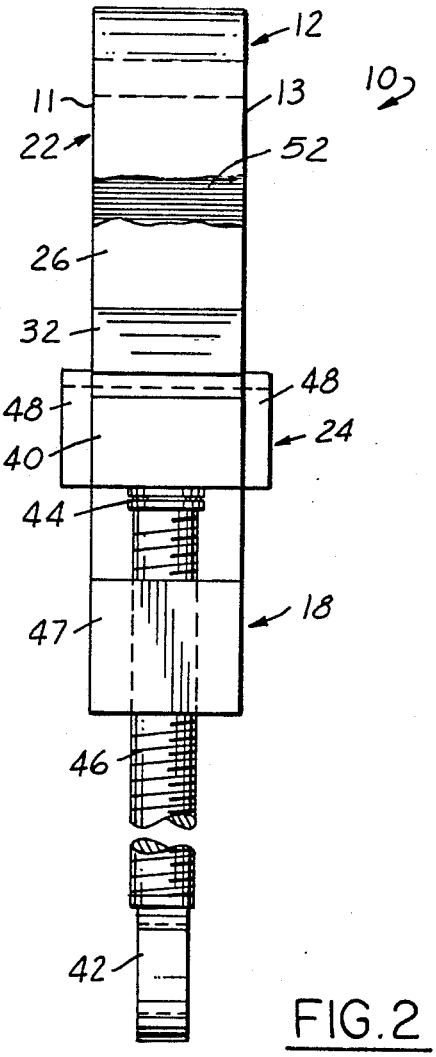
FIG. 2 is a view of the hot line clamp as seen from the left in FIG. 1.

Referring now more particularly to the drawings, the clamping device is indicated by the numeral 10 and has a body 12 of electrically conducting material such as aluminum or copper. The body 12 has an elongated central portion 14 and a base 16 extending cross-wise of the central portion. The body 12 has flat, parallel, front and rear surfaces 11 and 13.

The clamping device 10 has clamps 18 and 20. Clamp 18 has jaws 22 and 24. Jaw 22 is an integral part of the body 12. The jaw 22 is formed by two elongated legs 26 and 28, the leg 28 being constituted by the upper part of the central portion 14 of body 12. The upper ends of legs 26 and 28 are integrally connected together at 30. Leg 26 is cantilevered from the connection point 30 and extends downwardly therefrom at an acute angle to leg 28, terminating in an outwardly flared lip 32.

The legs 26 and 28 form a V-shaped recess 34, defined by the converging surfaces 36 and 38 of the legs. The recess is open at the lower end. The converging surfaces are at right angles to the front and rear surfaces 11 and 13 of the body 12, and are disposed at an acute angle to one another in the range of about 15 to 30 degrees and preferably about 26 degrees.

The jaw 24 has a contact block 40 which is concavely recessed at 41 on the top to conform to the generally circular contour of a line conductor. This block 40 is mounted on an eyebolt 42. More specifically, a thrust bearing 44 is mounted on the upper end of the threaded shank 46 of the eyebolt and the block 40 is seated on the thrust bearing. Block 40 is wedge-shaped, having tapering sides 45.

The eyebolt 42 threadedly engages a threaded opening in one side portion 47 of base 16 of the body 12, for longitudinal movement on a line which bisects the V-shaped recess 34.

The block 40 is machined from one piece and has integral side guide plates 48 on the front and back sides of the block 40. As seen in FIG. 2, the plates 48 overlap and engage the front and back surfaces of the legs 26 and 28 and of central body portion 14 during movement of the jaw 24 relative to jaw 22, to keep the block 40 from rotating. The upper edges of the plates 48 have concave recesses 50 which are flush with and form extensions of the concave recess 41 at the top of block 40.

The cantilevered leg 26 is flexibly resilient to enable it to swing away from leg 28 and open the recess slightly during clamping and also in the event the clamped conductor should heat up and expand.

The converging surfaces 36 and 38 are serrated as indicated in the cut-away portion of FIG. 2 at 52. The serrations may have alternating V-shaped ridges and grooves which extend in straight parallel lines at right angles to the front and rear surfaces 11 and 13 of the body 12.

Figure 1:
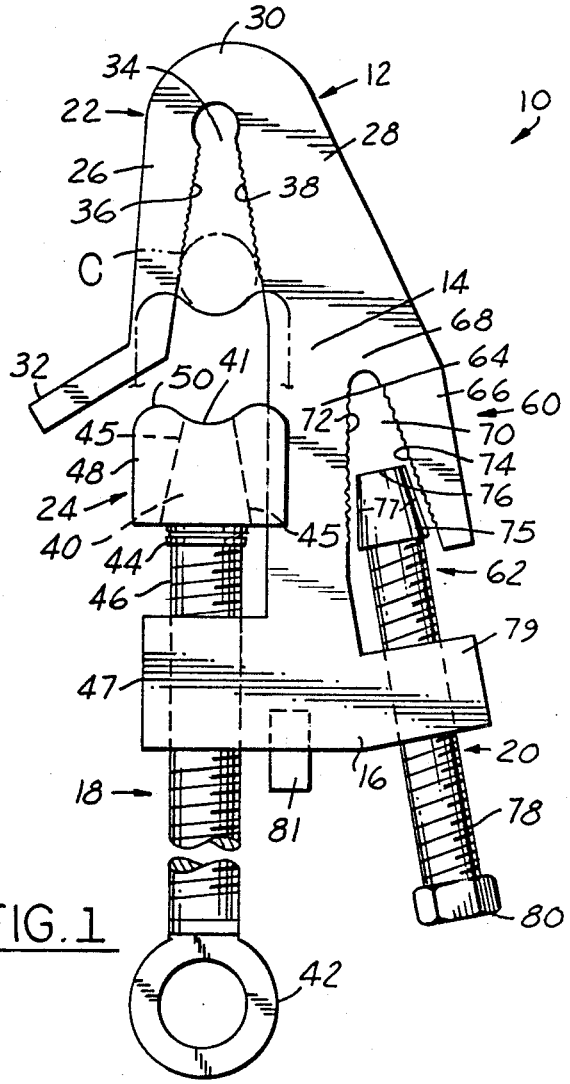
FIG. 1 is a front elevational view of a self-cleaning hot line clamp constructed in accordance with this invention.

A line conductor C may be clamped in clamp 18 by turning the eyebolt with a long pole such as a hotstick or shotgun in a direction to withdraw jaw 24 from the FIG. 1 position sufficiently to enable the line conductor to be inserted between the jaw 24 and the lip 32 of jaw 22. The eyebolt is then turned in the opposite direction to advance the jaw 24 into the V-shaped recess 34 of jaw 22, causing block 40 to force the line conductor up into the recess in wedging contact with the serrated converging surfaces 36 and 38. The angle of the converging surfaces is such that the serrations will have a wiping action on the surface of the line conductor at the contact points as the line conductor is forced up into the V-shaped recess, removing any surface oxide that may be present at the contact points. The torque applied to the eyebolt will produce increased clamping pressure on the line conductor because of the thrust bearing and anodizing of the eyebolt.

Figure 3:
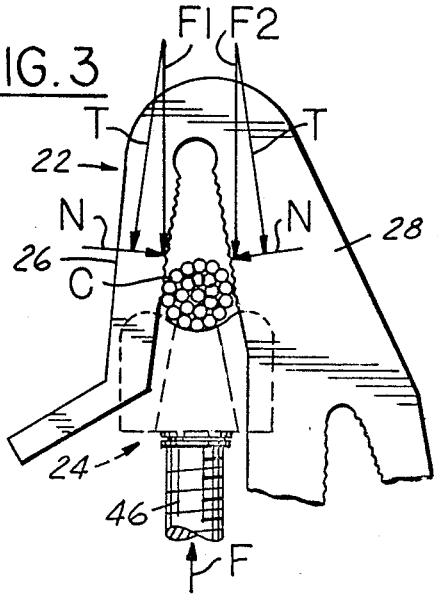
FIG. 3 is a semi-diagrammatic view illustrating a portion of the clamp in FIG. 1 and showing the forces applied to the conductor when clamped.

FIG. 3 shows the line conductor after it has been clamped in the recess 34. The letters N indicate the direction and magnitude of the normal forces on the line conductor. The letters T indicate the tangential forces, and the letters F1 and F2 the sums of these forces. The combined forces F1 and F2 equal the opposing force F of jaw 24.

Figure 4:
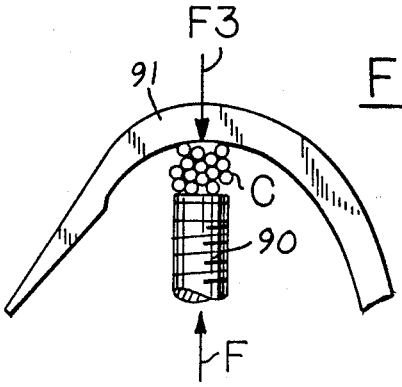
FIG. 4 is also a diagrammatic view but illustrates the prior art.

FIG. 4 is a view of the prior art showing a line conductor being clamped between two jaws 90 and 91 of a clamping device in which the jaw 91 is shaped so that there is no wiping action, all of the force being concentrated in one direction normal to the line conductor. The force F applied by the jaw 90 is opposed by the equal and opposite force F3 of jaw 91.

The clamp 20 has jaws 60 and 62. The jaw 60 is generally similar to the jaw 22 of clamp 18. Jaw 60 is formed by two elongated legs 64 and 66, the leg 64 being constituted by the lower part of the central portion 14 of body 12. The upper ends of legs 64 and 66 and integrally connected together at 68. Leg 66 is cantilevered from the connection point 68 and extends downwardly therefrom at an acute angle to leg 64.

Legs 64 and 66 form a V-shaped recess 70, defined by the converging surfaces 72 and 74 of the legs. The recess is open at the lower end. The converging surfaces are at right angles to the front and rear surfaces 11 and 13 of the body 12, and are disposed at an acute angle to one another which is preferably the same as the converging surfaces of clamp 18, that is in the range of about 15 to 30 degrees and preferably about 26 degrees.

The jaw 62 has a contact block 75 which is in the form of a wedge the top surface 76 of which is flat and at right angles to the longitudinal centerline of the wedge. The wedge 75 has tapering sides 77 and is mounted so as to swivel on the upper end of a threaded bolt 78. The bolt threadedly engages a threaded opening in the side portion 79 of base 16 of the body 12, for longitudinal movement on a line which bisects the V-shaped recess 70. The bolt 78 has a hex-shaped head 80 rigidly formed on its lower end.

The converging surfaces 72 and 74 are serrated in the same manner as clamp 10. Thus, the serrations may have alternating V-shaped ridges and grooves which extend in straight parallel lines at right angles to the front and rear surfaces 11 and 13 of the body 12.

An alignment pin 81 is secured in a socket in the base 16 of body 12, as by a press bit or by threading. The alignment pin 81 extends generally parallel to the eyebolt 42 to engage a slot in the end of the hot stick to prevent sidewise movement or swiveling of the clamp when the clamp 18 is being applied to a line conductor.

A line or tap conductor may be clamped in clamp 20 in substantially the same manner as it is clamped in clamp 18, although the block 75 cannot be withdrawn far enough to enable the conductor to be inserted laterally into the recess. The conductor or other piece of electrical equipment may be inserted end-wise into the V-shaped recess above the block 75. The block 75 may be advanced by threading the bolt 78 upwardly, forcing the conductor or other piece of electrical equipment up into the recess in wedging contact with the serrated converging surfaces 72 and 74, with the same wiping action described heretofore in connection with clamp 18. The bolt is torqued by a wrench or other suitable tool applied to the head 80 thereof. The leg 66 is, like leg 26 of clamp 18, also flexibly resilient and for the same purpose.

What is claimed is:

1. A self-cleaning hot line clamping device for electrically connecting a line conductor to another piece of electrical equipment such as a second line conductor, said hot line clamping device comprising electrically connected first and second clamps for said first-mentioned line conductor and said other piece of electrical equipment, respectively, said first clamp including first and second clamping jaws, said first jaw having a V-shaped recess with converging surfaces extending at an acute angle to one another from the wide end of said V-shaped recess to the apex thereof, means supporting said second jaw adjacent the wide end of said V-shaped recess for movement toward the apex of said V-shaped recess on a line substantially bisecting said V-shaped recess to force a line conductor into said recess toward the apex thereof in wedging contact with said converging surfaces, said converging surfaces being serrated to have a wiping action on the line conductor at the contact points so that when said line conductor is forced into said V-shaped recess as aforesaid, any surface oxide on the line conductor at the contact points will be removed.

2. The hot line clamping device defined in claim 1, wherein said confronting surfaces of said V-shaped recess are disposed at an angle to one another of about 15 to 30 degrees.

3. The hot line clamping device defined in claim 1, wherein said confronting surfaces of said V-shaped recess are disposed at an angle to one another of about 26 degrees.

4. The hot line clamping device defined in claim 1, including a screw and a thrust bearing, said thrust bearing being mounted on the end of said screw and said second clamping jaw being seated on said thrust bearing.

5. The hot line clamping device defined in claim 1, wherein said first jaw is flexible enabling said converging surfaces of said recess to flex away from one another when a line conductor is forced into said recess as aforesaid.

6. The hot line clamping device defined in claim 1, wherein said first jaw has an elongated cantilevered element on which is provided one of said converging surfaces, said elongated element being flexible so that said one converging surface can flex away from the other converging surface when a line conductor is forced into said recess as aforesaid.

7. The hot line clamping device defined in claim 1, including a clamp body of electrically conducting material, and wherein said first jaw of said first clamp and at least a part of said second clamp are integral portions of said clamp body.

8. The hot line clamping device defined in claim 7, wherein said converging surfaces of said V-shaped recess are disposed at an angle to one another of about 15 to 30 degrees, said first jaw has an elongated element cantilevered at one end to said clamp body and on which is provided one of said converging surfaces, and said elongated element is flexible so that said one converging surface can flex away from the other converging surface when a line conductor is forced into said recess as aforesaid.

9. The hot line clamping device defined in claim 8, wherein said converging surfaces of said V-shaped recess are disposed at an angle to one another of about 26 degrees.

10. The hot line clamping device defined in claim 9, including a screw and a thrust bearing, said thrust bearing being mounted on the end of said screw and said second clamping jaw being seated on said thrust bearing.

* * * * *